US007316229B2

(12) United States Patent
Jaye

(10) Patent No.: US 7,316,229 B2
(45) Date of Patent: Jan. 8, 2008

(54) PICKLE TANK HEATING SYSTEM AND METHOD FOR LIQUID HEATING

(76) Inventor: W. David Jaye, 218 Williamsburg St., Catoosa, OK (US) 74015

( * ) Notice: Subject to any disclaimer, the term of this patent is extended or adjusted under 35 U.S.C. 154(b) by 124 days.

(21) Appl. No.: 11/047,214

(22) Filed: Jan. 29, 2005

(65) Prior Publication Data

US 2005/0166910 A1 Aug. 4, 2005

Related U.S. Application Data

(60) Provisional application No. 60/541,153, filed on Feb. 2, 2004.

(51) Int. Cl.
*F24H 1/20* (2006.01)

(52) U.S. Cl. ..... 126/360.2; 126/360.1; 126/391.1

(58) Field of Classification Search ..... 126/39.1, 126/360.1, 360.2; 122/31.2; 392/451
See application file for complete search history.

(56) References Cited

U.S. PATENT DOCUMENTS 2,611,362 A * 9/1952 Swindin ..... 126/360.2
2,643,938 A * 6/1953 Robinson ..... 423/528
4,102,330 A * 7/1978 Hutchinson ..... 126/374.1
4,327,671 A * 5/1982 Zimmer, Sr. ..... 122/44.2
4,685,444 A * 8/1987 Durrenberger ..... 126/360.2
5,271,378 A * 12/1993 Herold ..... 126/360.2

* cited by examiner

*Primary Examiner*—Alfred Basichas
(74) *Attorney, Agent, or Firm*—James L. Jackson

(57) ABSTRACT

The general concept of this invention is to utilize the high efficiency of heat transfer that is obtained by allowing the exhausting gas from the burner to come into intimate contact with the liquid to be heated. A housing adapted for partial immersion in the liquid of the tank and has an internal liquid heating chamber and defines inlet and outlet openings. A burner tube is supported within the housing and extends into the liquid and provides a combustion gas discharge opening. A burner assembly having a supply of combustible gas and air is in communication with the burner tube and has a burner nozzle being positioned to direct a flame into the burner tube. The burner tube has sufficient length for substantially complete combustion of a gas/air mixture within said burner tube and to discharge hot combustion gas into the liquid within said internal liquid heating chamber. The flame and hot combustion gas efficiently heat the liquid circulating through the chamber via the inlet and outlet openings.

23 Claims, 2 Drawing Sheets

PICKLE TANK HEATING SYSTEM AND METHOD FOR LIQUID HEATING

RELATED PROVISIONAL APPLICATION

Applicant hereby claims the benefit of U.S. Provisional Patent Application No. 60/541,153, filed on Feb. 2, 2004 by W. David Jaye and entitled "Thermaflow Pickle Tank Heating System".

BACKGROUND OF THE INVENTION

1. Field of the Invention

The present invention relates generally to methods and apparatus for heating of liquids in process tanks used primarily in industrial manufacturing. More particularly the present invention concerns galvanizing systems, particularly corrosive liquids in pickle tanks in which objects to be galvanized are cleaned and prepared for receiving a protective coating of zinc during subsequent galvanizing processes. Even more particularly, the present invention is directed to a heating system for efficiently heating the corrosive, i.e., acidic bath liquid of a pickle tank to enable low cost preparation of the parts for quality galvanizing.

2. Description of the Prior Art

The Galvanizing Process—The hot dip galvanizing process is a method of metallurgically alloying zinc to the outer surface of steel for the purpose of corrosion protection. The process involves processing the metal, typically steel, through several galvanizing process steps as follows:

1. Rack-up—Material to be galvanized is placed in tubs, racks or other fixtures or containers to facilitate transportation of the material through several process tanks.

2. Caustic—The material, also referred to as parts or pieces, is dipped into a bath of liquid caustic cleaner to remove oil, paint, grease, etc. The tank or bath is typically heated to at least 160° F.

3. Rinse—Residual caustic composition is removed in a water rinse bath.

4. Pickling—The material is dipped into an acid solution to remove rust, oxides, and mill scale. The most common acids for use in pickling tanks are hydrochloric acid and sulfuric acid, both being highly corrosive.

5. Rinse—Residual acid is removed in water rinse bath.

6. Pre-flux—The materials are dipped into a solution of zinc ammonium chloride to coat the material prior to transporting the material through a molten zinc bath. The zinc ammonium chloride solution will prevent the materials from oxidizing while the materials are waiting to be passed through the zinc bath.

7. Zinc Bath—The preflux coated material is then dipped into a bath of molten zinc. This is the part of the process where galvanizing of the material takes place. It is also there part of the process where a quantity of ash is created. The molten zinc bath is typically maintained at a temperature of about 840° F., although temperature ranges of the zinc bath may vary form about 825° F. to about 860° F.

In the hot dip galvanizing industry there exists a need to heat a pickle bath of corrosive acidic liquid in process tanks or baths. Currently there are several methods typically used to heat the process tanks. Most commonly is the use of a boiler to heat water to steam and then transport the steam to a bath in pipes, where the steam is either pumped directly into the tank or pumped through heat exchangers to liberate the heat of the steam into the liquid of the bath, thus heating the liquid. This method is quite inefficient and requires special permits to operate. Other methods include hot water heaters which are similar to the boilers, electric and submerged combustion. Electric heating is relatively efficient for heat transfer, but the cost of electricity for maintaining a desired temperature range in a large acidic bath is usually prohibitive in a large galvanizing operation.

SUMMARY OF THE INVENTION

It is a principal feature of the present invention to provide a novel method and apparatus for heating the corrosive acidic liquid of pickle tanks or baths, primarily in the hot dip galvanizing industry;

It is another feature of the present invention to provide a novel method and apparatus for causing very efficient heating the corrosive acidic liquid, typically sulfuric, acid rinse, or zinc ammonium chloride of pickle tanks or baths to temperatures of from about 14020 , F. to about 160°, F.

Briefly, the various objects and features of the present invention are realized through the provision of a novel system for very efficiently heating the acidic and highly corrosive liquid in a pickle tank. The general concept of this invention is to utilize the high efficiency of heat transfer that is obtained by allowing the exhausting gas from the burner to come into intimate contact with the liquid to be heated. High efficiency of heat transfer is obtained by causing combustion of a gas and air mixture within the pickling tank to develop a combustion exhaust gas and causing the hot exhaust gas from the burner to come into intimate contact with the liquid to be heated. A heater unit composed of corrosion resistant material and having a burner therein is fueled by a combustible gas and air mixture. The heater unit is at least partially immersed in the liquid of a pickling bath so that the burner is in contact with the liquid of the bath. The burner is charged with a combustible gas/air mixture a defines a burner opening from which the combustion exhaust gas is liberated into the pickling fluid of the tank. The burner is of tubular design and is of sufficient length that complete combustion of the combustible gas/air mixture occurs within the tubular burner, thus liberating a non-combustible gaseous medium from the burner and into the liquid of the acidic bath.

The acidic bath heating apparatus defines a heater housing structure that is preferably composed of a corrosion resistant material such as polypropylene or any other suitable polymer or plastic that is capable of resisting the corrosive effects of the heated corrosive liquid of the pickle bath. The heater housing structure of the heating apparatus is positioned within the tank or bath in such manner as to cause a portion of the device to be submerged beneath the liquid level within the tank. Preferably the heater housing structure is located at one end of the pickle tank so that it will not interfere with conveyance of materials into and from the pickle tank. The heater housing structure is constructed in such a way as to provide a chamber within it to accommodate a burner tube and baffle. The liquid heating chamber will typically be comprised of four side panels, a top panel, and several panels that are designed and oriented to create an opening in the bottom to accommodate a burner tube and baffle. The heating chamber is comprised of four side panels designed to create an opening in the bottom. A burner tube is positioned in the chamber through the top panel and extends vertically downward and has a 90° bend so that its terminal end is oriented substantially horizontally. The horizontally oriented section of the burner tube extends a short distance from its vertical section and provides a combustion gas discharge opening that is oriented substantially horizontally.

The burner tube, preferably composed of graphite, has a burner mechanism attached to its upper portion, thus causing a flame to be directed downward through the tube. The length of the burner tube is sufficient allow complete combustion of the gas/air mixture within the burner tube before exhausting the combustion gases from the discharge opening into the liquid that is contained within the heating chamber. A baffle is positioned inside the chamber in such a way as to force the exhaust of the burner in a direction towards the vertical portion of the burner tube.

At least one heated liquid outlet opening is provided in the side of the housing (more than one outlet opening may be needed for larger or higher capacity liquid heaters) to allow the exhausting burner gases to escape the housing.

The bottom portion of the housing tapers together to form a small opening which will allow a flow of liquid from below the liquid heater to be drawn into the chamber by a venturi effect caused by the exhausting burner flow. A flange may be incorporated at the top of the housing on the outside to facilitate mounting inside a tank to be heated.

A corrosive liquid heater embodying the principles of the subject invention is highly efficient to temperatures up to 160° F. and is preferably made of corrosive resistant materials for use in acidic liquids. The present invention offers particular advantages in heating corrosive bath liquids used in the hot dip galvanizing industry. It should be borne in mind however, that the present invention has application for heating a wide variety of different liquids for use in a wide variety of industrial applications. Thus, it is intended that this specification serve to present one possible example of a liquid heating system embodying the principles of the present invention.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevational view showing a pickle tank having a liquid heater supported by the upper portion thereof, the liquid heater mechanism being constructed according to the principles of the present invention;

FIG. 2 is an elevational view showing the liquid heater mechanism of FIG. 1 separated from the pickle tank and having internal components thereof shown in broken line;

FIG. 3 is a side elevational view taken along line 3-3 of FIG. 2 and having internal components thereof shown in broken line; and FIG. 4 is a sectional view taken generally along line 4-4 of FIG. 1 and showing the internal structural components of the liquid heater mechanism in detail.

DETAILED DESCRIPTION OF PREFERRED EMBODIMENT

Figure 1:
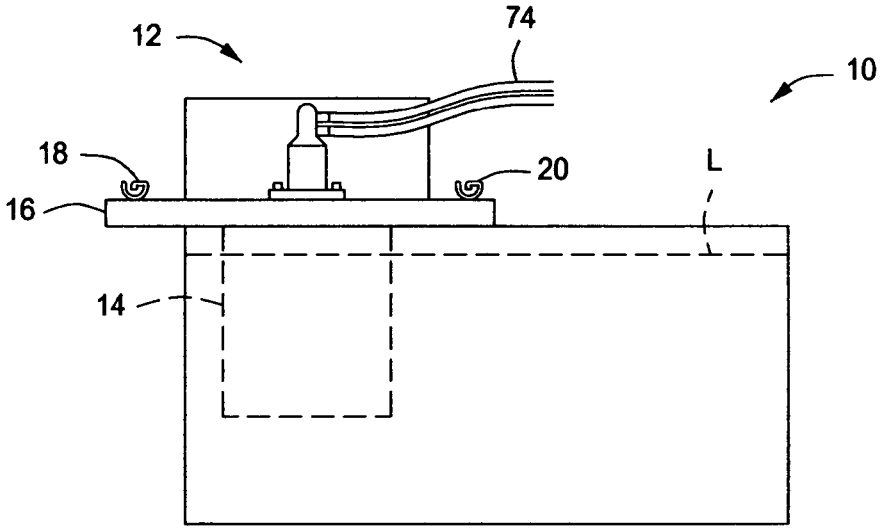

Referring now to the drawings and first to FIG. 1, a pickle tank is shown generally at 10 and may be of a dimension for containing 15000 gallons more or less of corrosive acidic liquid, depending on the size and other characteristics of the parts or materials being galvanized and the character of the galvanizing process with which it is used. The maximum liquid level of the pickle tank is indicated by reference L. A liquid heating mechanism for the pickle tank 10, also referred to herein as a "heater unit", is shown generally at 12 and defines a housing shown generally at 14 that is at least partially immersed within the liquid of the pickling tank. A heater support 16 typically is mounted to or supported by the upper portion of the pickle tank and is provided with lifting eyes 18 and 20 to permit the heater mechanism to be installed to and removed from the pickle tank as needed for installation, repair or maintenance thereof. Alternatively, the liquid heating mechanism 14 may be provided with one or more mounting flanges 21 that are optional and permit mounting of the liquid heating mechanism to a pickle tank.

The liquid heating mechanism incorporates a housing structure, shown generally at 22, that is resistant to the corrosive effects of the acidic liquid within the pickling tank. The housing structure 22 defines a heating chamber 23 that receives liquid to be heated and permits discharge of heated liquid from the heating chamber into the pickling tank. One side portion of the housing 22 is defined by a flat panel 24 composed of a sheet of acid resistant material such as polypropylene and being connected and sealed to a front panel 26 and a rear panel 28. It should be borne in mind that the terms "front" and "rear" are arbitrary, since the heater unit may be oriented in any suitable manner within the pickle tank as long as a portion of the housing 22 is immersed in the liquid within the tank. A flat panel 30 provides a closure for an upper portion of one side of the housing 22 and a top panel 32 provides an upper closure for the housing. The various acid resistant panels of the housing structure may be heat sealed or chemically sealed to one another to form the housing 22 or they may be assembled in any other suitable manner to provide a housing structure that is resistant to the corrosive effects of the acidic pickling liquid.

Figure 2:
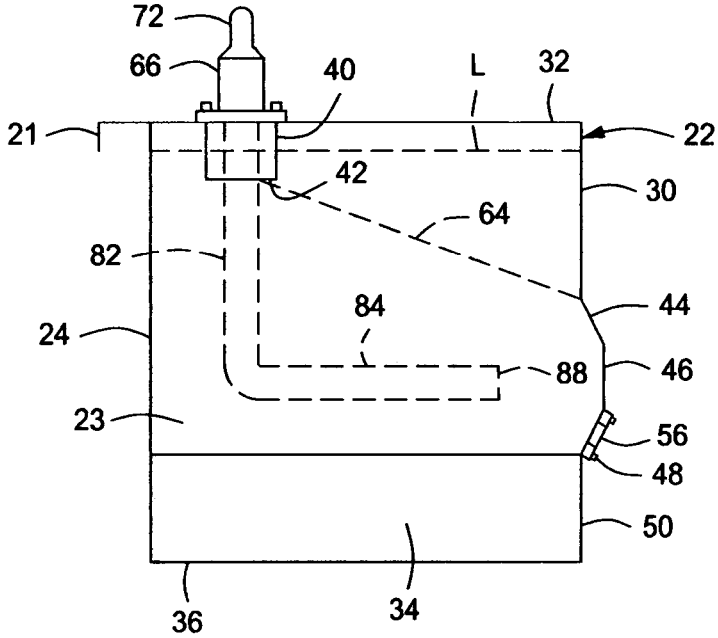
Figure 3:
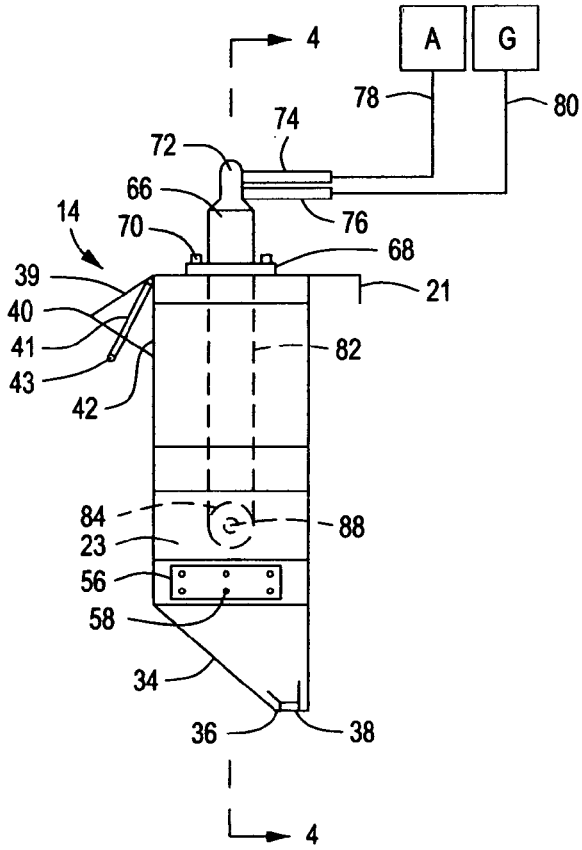

A bottom portion of the housing 22 is defined by an inclined panel wall 34 that is fixed and sealed to the rear panel 28 and is disposed in converging relation with the front panel 26. The lower end 36 of the inclined panel wall 34 is disposed in spaced relation with the front panel 26 and defines a liquid inlet opening 38 through which liquid is drawn by thermal convection and/or a venturi effect that is responsive to the heating of liquid within the housing 22. A liquid and gas outlet structure 40 is mounted about an outlet opening 42 that is defined in the upper portion of the rear panel 28 as is evident in FIGS. 2 and 3. The liquid and gas outlet structure defines an inclined wall 39 that directs discharged heated liquid and combustion gas downwardly and outwardly so that the discharge is more adequately confined to the pickle tank. Also the liquid and gas outlet structure 40 may be provided with an adjustable discharge control baffle 41 having a control handle or projection 43 so that the discharge from the outlet opening may be adjusted with the heater unit mounted to a liquid filled pickle tank and ready for operation.

Generally rectangular housing panels 44, 46, 48 and 50 each define portions of an end wall structure of the housing 22. Housing panels 44 and 48 are positioned in angulated relation with respect to the vertical and horizontal and are connected to the substantially vertically oriented panel 46, thus forming a combustion gas diversion pocket 52 toward which combustion gases are directed as indicated below. The angulated generally rectangular housing panel 48 defines an inspection opening 54 which is normally closed by an inspection plate 56 that is secured to the panel 48 by a plurality of bolts 58. When corrosive liquid has been removed from the pickle tank or the liquid level within the pickle tank is below the bottom portion of the liquid heater housing 14 or when the liquid heater housing has been removed from the pickle tank, the inspection plate may be removed from the housing panel 48 by removing the panel mounting bolts 58. The interior of the liquid heater housing then may be inspected to determine if its use may be continued or if repairs or replacement may be appropriate.

A pair of inclined support members 60 are fixed to the interior surfaces of the front and rear walls 22 and 26 and provide inclined support shoulders 62 on which respective side portions of an inclined interior baffle or plate 64 are supported. The inclined interior baffle or plate is positioned so that its upper end is located below the pickle bath liquid level within the heating chamber 23 liquid heating housing 22 and near the burner assembly. The inclined interior baffle serves to conduct bubbles of the liberated combustion gas upwardly and laterally through the pickle bath liquid within the heating chamber so that the liberated gas emerges from the surface of the liquid of the heating chamber near the liquid and gas outlet opening 42. The inclined interior baffle thus serves to maintain the liberated combustion gas within the liquid so that the heat of the combustion gas is more efficiently transferred to the liquid. Thus, as the combustion gas moves upwardly and laterally through the heating chamber it transfers much of its heat to the pickle bath liquid and becomes substantially cooled by the heat transfer. The reduced temperature combustion gas emerges from the liquid/gas interface L within the heating chamber, its bubbling activity develops surface turbulence and splashing of pickle bath liquid/combustion gas bubbles onto the burner, thus serving to provide a cooling function for the burner.

A burner tube 66, preferably composed of graphite to withstand the heat of a flame generated by combustion of a gas/air mixture, is mounted to a tube support flange 68. The tube support flange 68 is mounted to the top panel 32 of the housing structure 22 by means of suitable fasteners 70 such as bolts, screws, stud and nut assemblies or the like. To the upper end of the burner tube 66 is mounted a burner assembly 72 having an air inlet conduit 74 and a gas inlet conduit 76. An air source "A", such as an air blower or a supply of compressed air is communicated with the air inlet conduit 74 by means of any suitable air supply conduit 78. The air source can be controlled so that the air input to the air inlet conduit 74 is proper for the character of flame that is desired. In the alternative, the burner assembly may be provided with selective controls for controlling the flow of air from the air source A for desired development of a proper air/gas mixture for desired combustion. A gas source "G" is also provided and is communicated via a gas supply conduit 80 with the gas inlet conduit 76. The gas source G or its gas supply conduit may be provided with a gas flow regulation system for proper mixture of the combustible gas with air for development of a desired flame within the burner tube 66. In the alternative, the burner assembly 72 may be provided with selective controls for controlling the flow of gas from the gas source.

Figure 4:
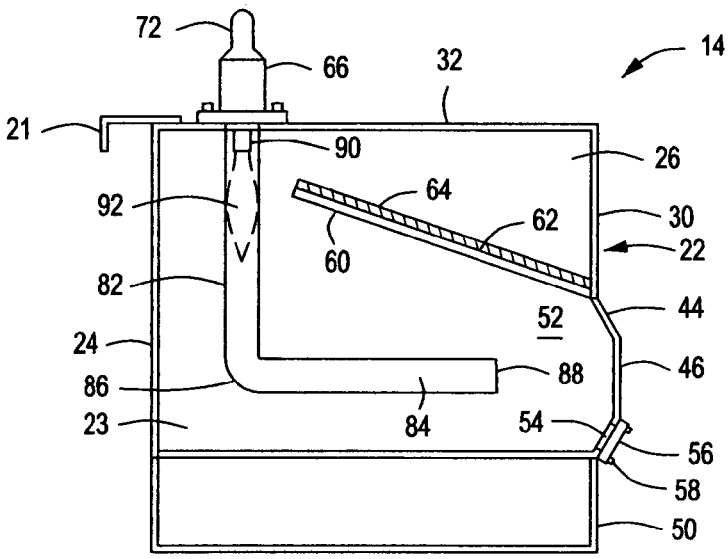

The burner tube 66, as mentioned above, is preferably composed of graphite or a graphite composite to ensure that it will withstand the effects of a gas/air flame within it. The burner tube comprises a substantially vertically oriented section 82 and a substantially horizontally oriented section 84, with a smoothly curved transition 86 merging with the vertical and horizontal sections. The horizontally oriented section 84 defines a discharge outlet opening 88 at its terminal end from which is discharged the combustion gas that is generated during combustion of the gas/air mixture. The burner assembly includes a burner nozzle 90 that projects downwardly into the vertical section of the burner tube and thus projects a flame 92 into the vertical section as shown in FIG. 4. The combined length of the vertically and horizontally oriented sections 82 and 84 is sufficient that substantially complete combustion of the gas/air mixture will occur within the burner tube and only the gas resulting from combustion will be discharged from the discharge opening 88 of the burner tube. As shown, the combined length of the vertically and horizontally oriented burner tube sections 82 and 84 is greater than the depth of the liquid heater housing at which the combustion gas discharge opening 88 is located. This feature causes the discharge opening 88 to be subject to a predetermined hydrostatic pressure of the pickle bath liquid and permits the burner tube to be of sufficient length that complete combustion of the fuel/air mixture takes place within the burner tube. This feature also causes the discharge opening of the burner tube to be disposed in facing relation with the combustion gas diversion pocket 52. The combustion gas is directed toward and into the diversion pocket 52 and reacts with the angulated housing panels 44 and 48 and with the laterally offset housing panel 46 and enhances the development of turbulence within the heating chamber 23 of the liquid heater housing. This combustion gas generated turbulence enhances the efficiency of heat transfer from the combustion gas to the pickle bath liquid of the heating chamber.

Though the flame 92 is shown to be located in the vertical section of the burner tube 66 it should be borne in mind that the flame may extend into the horizontal section of the burner tube as well. It is desirable, however, that complete combustion of the gas/air mixture occur within the burner tube so that only hot combustion gas is liberated into the heating chamber 23. The burner assembly 72 is equipped with an igniter device that is operative to ignite the gas/air mixture that is mixed therein. Preferably the igniter is electrically actuated and creates an ignition spark at the burner nozzle 90 which is located within the burner tube and above the maximum liquid level that may be present within the burner tube when the liquid heater mechanism is energized.

As mentioned above, the housing panels 44, 46 and 48 establish a flow diversion pocket 52 within the heating chamber 23. The flow diversion pocket is located such that the combustion gas discharge from the discharge opening 88 of the horizontal section 84 of the burner tube is directed into the diversion pocket. The angulated wall panels 44 and 40 cause the development of turbulence in the liquid that is present within the heating chamber 23 at any point in time. This turbulence agitates the fluid, thus causing efficient transfer of heat from the burner tube and from the hot combustion gas to the liquid. As the corrosive liquid is heated within the heating chamber the liquid tends to rise within the heating chamber due to thermal effect. Additionally, combustion gas liberated into the heating chamber forms a continuous stream of bubbles that rise toward the surface, i.e., liquid level L of the liquid within the heating chamber 23. The continuous stream of combustion gas bubbles, in addition to transferring heat from the hot combustion gas to the liquid, also create upward movement of the liquid within the heating chamber. The combustion gas bubbles are intercepted by the angulated baffle plate 62 and are caused to move upwardly and laterally along the lower surface of the baffle plate toward the outlet opening or openings 42 of the housing. Thus, the liquid within the heating chamber is caused to move generally upwardly as well as being agitated. This upward liquid movement creates a drawing effect to draw liquid from the pickle tank through the inlet opening 38 at the bottom of the housing structure 22 and simultaneously cause the flow of liquid as well as combustion gas from the heating chamber through the outlet opening 42 at the upper portion of the housing structure.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for heating a pickle bath liquid contained within an open top tank in which metal parts are prepared for galvanizing, comprising:

supporting a liquid heater housing with a major portion of the liquid heater housing being immersed in the pickle bath liquid, said liquid heater housing defining a diversion panel and an internal heating chamber having a pickle bath liquid level therein coincident with the liquid level of the open top tank, a pickle bath liquid inlet opening at a lower portion of the liquid heater housing for transfer of pickle bath liquid from the open top tank and into said internal heating chamber and a liquid and gas outlet opening at an upper portion of the liquid heater housing for transfer of heated pickle bath liquid from the internal heating chamber into the open top tank and for liberation of combustion gas from the liquid heater housing and a burner assembly supported by said liquid heater housing having a burner located above the pickle bath liquid level and having a burner tube being supported within the internal heating chamber and having and a combustion gas discharge opening in communication with the internal heating chamber and being oriented to direct combustion gas from said burner tube laterally toward said diversion panel;

supplying combustible gas and air to said burner;

developing a combustible gas/air mixture within said burner;

igniting the combustible gas/air mixture within said burner and generating a flame within said burner and burner tube, said flame causing substantially complete combustion of the combustible gas/air mixture within the burner and burner tube and developing a hot combustion gas;

conducting the hot combustion gas through said burner tube and discharging the combustion gas laterally from said combustion gas discharge opening into the liquid within the internal heating chamber and toward said diversion panel and developing liquid turbulence within said heating chamber; and causing thermal convection and combustion gas induced movement of liquid from the open top tank through said lower inlet opening of said liquid heater housing into the internal heating chamber and from the internal heating chamber through said upper outlet opening of said liquid heater housing into the open top tank.

2. The method of claim 1, wherein an inclined interior surface is located within said liquid heater housing and extends upwardly to a location near said upper outlet opening and said step of causing combustion gas and thermal convection induced movement of liquid comprises:

directing combustion gas bubbles from said combustion gas discharge opening within said internal heating chamber; and causing the gas bubbles to move upwardly and laterally along said inclined interior surface within said internal heating chamber and causing thermally induced upward and agitation movement of the liquid within said internal heating chamber and liberation of combustion gas from the pickle bath liquid within said internal heating chamber at a location near said upper outlet opening of said liquid heater housing.

3. The method of claim 1, wherein said diversion panel defines a combustion gas diversion pocket having inclined diversion surfaces and being disposed in facing relation with said combustion gas discharge opening and toward which combustion gas is directed from said combustion gas discharge opening of said burner tube, said step of causing movement of liquid comprises:

directing combustion gas from said burner tube laterally toward and into said combustion gas diversion pocket; and causing combustion gas induced agitation of liquid and combustion gas by said inclined diversion surfaces within said internal heating chamber for efficiency of heat transfer from the combustion gas to the pickle bath liquid.

4. The method of claim 3, wherein said burner tube has a substantially vertical tube section from the lower end of which extends a substantially horizontal tube section having a combustion gas discharge opening oriented laterally for substantially horizontal discharge of combustion gas into the pickle bath liquid within said liquid heating chamber, wherein an inclined interior baffle is located within said liquid heater housing and extends upwardly to a location near said liquid and gas outlet opening and said liquid heater housing has internal surfaces defining a flow diversion pocket located in facing relation with the combustion gas discharge opening to receive combustion gas discharged from said combustion gas discharge opening of said burner tube, said step of causing combustion gas induced agitation comprises:

directing said substantially horizontal discharge of combustion gas laterally into said combustion gas diversion pocket and creating liquid turbulence within said flow diversion pocket for efficiency of liquid heating by heat transfer from said combustion gas to said pickle bath liquid within said heating chamber; and causing movement of combustion gas upward from said flow diversion pocket along said inclined interior surface and said diversion panel toward said liquid and gas outlet opening of said liquid heater housing so that combustion gas emerges from liquid within said liquid heater housing and at a location adjacent said upper outlet opening.

5. The method of claim 3 wherein an inclined interior surface is located within said liquid heater housing and extends upwardly and laterally with its upper end located near said liquid and gas outlet opening, said method further comprising:

causing upward and lateral movement of combustion gas bubbles upwardly and laterally along said inclined interior surface within the pickle bath liquid of the liquid heating chamber, said combustion gas bubbles causing movement of liquid within said liquid heating chamber optimizing heat transfer of said combustion gas to the pickle bath liquid within said liquid heating chamber and causing liquid cooled combustion gas to be directed from the pickle bath liquid adjacent the burner tube and adjacent the liquid and gas outlet of said liquid heater housing.

6. a liquid heating system for an open top pickle bath tank having a pickle bath liquid therein for preparing metal parts for galvanizing, comprising:

a liquid heater housing being supported for partial immersion in the pickle bath liquid of the open top pickle bath tank and defining an internal liquid heating chamber, said liquid heater housing defining a diversion panel and a lower liquid inlet opening at a lower portion thereof and an upper liquid and gas outlet opening for discharge of pickle bath liquid and combustion gas at an upper portion of said internal liquid heater chamber into the open top pickle bath tank;

a burner assembly being supported by said liquid heater housing and having a portion thereof located above the level of pickle bath liquid within said liquid heater housing, said burner assembly having a fuel supply fitting and an air supply fitting;

a burner tube being supported by said burner assembly and having a major portion thereof located within the pickle bath liquid, said burner tube having a tube length of sufficient length to ensure substantially complete combustion of the fuel/gas mixture within said burner tube and having a combustion gas discharge opening;

a burner nozzle mounted to said burner assembly and extending into said burner tube and being positioned to direct a flame into said burner tube; and said combustion gas discharge opening of said burner tube being oriented to discharge hot combustion gas from said combustion gas discharge opening into the pickle bath liquid within said internal liquid heating chamber and laterally toward said diversion panel.

7. The liquid heating system of claim 6, comprising:

said housing being composed of materials that are substantially resistant to the corrosive effects of an acidic liquid.

8. The liquid heating system of claim 6, comprising:

said burner tube being composed of a fire and acid resistant material.

9. The liquid heating system of claim 6, comprising:

said burner tube being composed of graphite.

10. The liquid heating system of claim 6, comprising:

said burner tube having a substantially vertically oriented tubular section and a substantially horizontally oriented tubular section defining said combustion gas discharge opening at the terminus thereof and locating said combustion gas discharge opening at a depth within said pickling liquid that is less than the combined lengths of said substantially vertically oriented section and said substantially horizontally oriented section.

11. The liquid heating system of claim 6, comprising:

said diversion panel of said liquid heater housing having upper and lower angulated wall panels and a substantially vertically oriented panel located between and interconnected with said upper and lower angulated wall panels and defining a flow diverting pocket within said internal liquid heating chamber and facing said combustion gas discharge opening; and said combustion gas discharge opening of said burner tube directing combustion gas laterally into said flow diverting pocket and generating turbulence in the pickle bath liquid within said internal liquid heating chamber for enhancing the efficiency of heat transfer from the combustion gas to the pickle bath liquid.

12. The liquid heating system of claim 11, comprising:

an inclined baffle being located within said internal liquid heating chamber and having angulated orientation and having a lower end located adjacent said flow diverting pocket and an upper end located adjacent said top outlet opening, said baffle intercepting combustion gas liberated from said combustion gas discharge opening and flow diverting pocket and conducting the combustion gas upwardly and laterally toward said upper outlet opening.

13. The liquid heating system of claim 6, comprising:

said liquid heater housing having converging lower walls being spaced at lower ends thereof and defining said lower pickle bath liquid inlet opening through which pickle bath liquid enters said internal heating chamber from the open top tank;

said liquid heater housing having an upper wall portion defining said upper outlet opening; and said lower liquid inlet opening said internal liquid heating chamber and said upper liquid and gas outlet opening of said liquid heater housing defining a circulation path ensuring convection and combustion gas induced upward movement of liquid through said internal liquid heating chamber of said liquid heater housing and causing efficient transfer of heat from hot combustion gas discharged from said combustion gas discharge opening of said burner tube to pickle bath liquid within said internal heating chamber of said liquid heater housing.

14. The liquid heating system of claim 13, comprising:

a liquid and gas outlet deflection baffle structure being fixed to said upper wall portion of said liquid heater housing adjacent said upper liquid and combustion gas outlet opening and defining a downwardly and outwardly inclined liquid and gas discharge directing wall deflecting pickle bath liquid and combustion gas discharge downwardly and outwardly from said upper liquid and gas outlet opening of said liquid heater housing and into the open top tank.

15. The liquid heating system of claim 14, comprising:

a discharge control baffle being mounted to said liquid and gas outlet structure and having a control handle and being movable for controlling the direction of liquid and gas discharge from said upper liquid and combustion outlet opening.

16. A pickle bath liquid heating system for an open top tank having a pickle bath liquid therein for preparing metal parts for galvanizing, comprising:

a liquid heater housing having front, rear, side and top walls and being supported by the open top tank and having a portion thereof immersed in the pickle bath liquid, said liquid heater housing defining an internal liquid heating chamber and a diversion panel within said internal liquid heating chamber and having a liquid inlet opening at a lower portion thereof and a liquid and combustion gas outlet opening at an upper portion thereof;

a burner assembly being supported by said liquid heater housing and having a portion thereof located above the level of pickle bath liquid within said liquid heater housing, said burner assembly having a fuel supply fitting and an air supply fitting;

a burner assembly being supported by said liquid heater housing in communication with said burner tube and receiving a combustible gas and air and developing a combustible gas/air mixture and having a burner nozzle projecting into said burner tube and directing a flame of said combustible gas/air mixture into said burner tube;

a burner tube being supported by said burner assembly and having a portion thereof projecting downwardly into the pickle bath liquid within said internal liquid heating chamber, said burner tube having a combustion gas discharge opening at the terminus thereof being oriented toward said diversion panel and directing combustion gas into said internal liquid heating chamber toward said diversion panel; and said burner tube having sufficient length to cause substantially complete combustion of said combustible gas/air mixture within said burner tube and to discharge hot combustion gas from said combustion gas discharge opening laterally into the pickle bath liquid within said internal liquid heating chamber and toward said diversion panel.

17. The liquid heating system of claim 16, comprising:

The liquid heating system of claim 16, comprising:

said housing being composed of materials that are substantially resistant to the corrosive effects of an acidic liquid.

18. The liquid heating system of claim 16, comprising:

said burner tube being composed of a fire resistant material.

19. The liquid heating system of claim 16, comprising:

said burner tube being composed of graphite.

20. The liquid heating system of claim 16, comprising:

said burner tube having a substantially vertically oriented tubular section and a substantially horizontally oriented tubular section defining said combustion gas discharge opening at the terminus thereof.

21. The liquid heating system of claim 16, comprising:

said housing having upper and lower angulated housing panels and a substantially vertically oriented panel located between and interconnected with said upper and lower angulated housing panels and defining a flow diverting pocket within said internal liquid heating chamber, one of said upper and lower angulated housing panels being said diversion panel; and said combustion gas discharge opening of said burner tube directing combustion gas toward said flow diverting pocket and generating turbulence in the liquid within said internal liquid heating chamber.

22. The liquid heating system of claim 21, comprising:

a baffle being supported within said internal liquid heating chamber by said housing and having angulated orientation therein and having a lower end located adjacent said flow diverting pocket and an upper end located adjacent said outlet opening, said baffle intercepting combustion gas liberated from said combustion gas discharge opening and conducting the combustion gas upwardly and laterally along said baffle toward said upper outlet opening.

23. The liquid heating system of claim 16, comprising:

said housing having converging lower walls being spaced at lower ends thereof and defining said liquid inlet opening;

said housing having an upper wall portion defining said outlet opening; and said liquid inlet opening and said outlet opening and said housing defining a circulation path ensuring upward movement of liquid through said housing and efficient transfer of heat from said burner tube and said combustion gas to liquid within said housing.

* * * * *